US007552613B1

(12) United States Patent
Chuan

(10) Patent No.: US 7,552,613 B1
(45) Date of Patent: Jun. 30, 2009

(54) BENDING MACHINE

(75) Inventor: James Chuan, Taipei Hsien (TW)

(73) Assignee: First Forever Co., Ltd., Taipei Hsien (TW)

( * ) Notice: Subject to any disclaimer, the term of this patent is extended or adjusted under 35 U.S.C. 154(b) by 0 days.

(21) Appl. No.: 12/150,495

(22) Filed: Apr. 29, 2008

(51) Int. Cl.
*B21D 9/10* (2006.01)

(52) U.S. Cl. ..... 72/389.8; 72/389.3

(58) Field of Classification Search ..... 72/389.1, 72/389.2, 389.3, 389.6, 389.7, 389.8
See application file for complete search history.

(56) References Cited

U.S. PATENT DOCUMENTS 3,552,179 A * 1/1971 Kapustin ..... 72/389.1
6,176,115 B1 * 1/2001 Van Ryper et al. ..... 72/389.1

* cited by examiner

*Primary Examiner*—David B Jones
(74) *Attorney, Agent, or Firm*—William E. Pelton, Esq.; Cooper & Dunham LLP

(57) ABSTRACT

A bending machine has a base and a stage having a movable ram to press a metal plate on the base with a shaping process. The base has an opening corresponding to the ram to allow the ram to pass through the opening. The stage has a pivotal end mounted pivotally with a side of the base, and a detachable end detachably mounted with the other side of the base and adjacent to the opening of the base. When a shaped metal plate tightly clamps the ram, the detachable end of the stage can be detached from the base, the stage can be pivoted to release the ram from the metal plate. Thus, to disassemble the bending machine is unnecessary, and the bending machine is convenient in use and operation and is simple in structure.

3 Claims, 6 Drawing Sheets

BENDING MACHINE

BACKGROUND OF THE INVENTION

1. Field of the Invention

The present invention relates to a bending machine, and more particularly to a bending machine that is convenient in use and operation, and is simple in structure.

2. Description of Related Art

Bending process is a widely used in modern metalworking industry. Compression, ramming or pressing are normal methods of bending process, with these methods, a part of a metal plate is clamped or held in position and a free end of the sheet is deformed by a movable ram.

A bending machine is provided for such a bending process, especially for compression, ramming or pressing. With reference to FIGS. 5 and 6, generally, a bending machine comprises a base (30) and a stage (40). The base (30) has a mold die (31) defining a flat surface for placing a metal plate, and the mold die (31) may have a gap, a hole or any other structure for shaping process. The stage (40) is mounted securely with the base (30) via fasteners like bolts or screws, and has a ram (42) opposite to the gap, the hole or the shaping structure. The ram (42) is movably mounted on the stage (40) and is selectively driven by a driver (41) to press the metal plate to deform the metal plate based on the gap, the hole or the shaping structure.

However, when the ram (42) is tightly clamped by a deformed metal plate and the ram (42) is unable to retract via a reversal operation of the driver (41), the stage (40) has to be detached from the base (30) to release the ram (42). This causes a lot of inconvenience and causes process time-consuming.

The present invention therefore provides a bending machine to obviate or mitigate the aforementioned problems.

SUMMARY OF THE INVENTION

The main objective of the present invention is to provide a bending machine that is convenient in use and operation and is simple in structure.

To achieve the objective, the bending machine comprises a base and a stage. The base defines a flat surface on which a metal plate is placed, and may have a gap, a hole or any other shaping structure. The stage is connected with the base and has a ram corresponding to the gap, the hole or the shaping structure. The ram is movably mounted on the stage and is selectively driven by a driver like a linear motor or cylinder to press and shape the metal plate based on the shape of the gap, the hole or the shaping structure.

The base has an opening defined through a side. The opening corresponds to the ram and allows the ram to pass through the opening. The stage has a pivotal end and a detachable end. The pivotal end is mounted pivotally with a side of the base, and the detachable end is detachably mounted with the other side of the base and adjacent to the opening of the base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
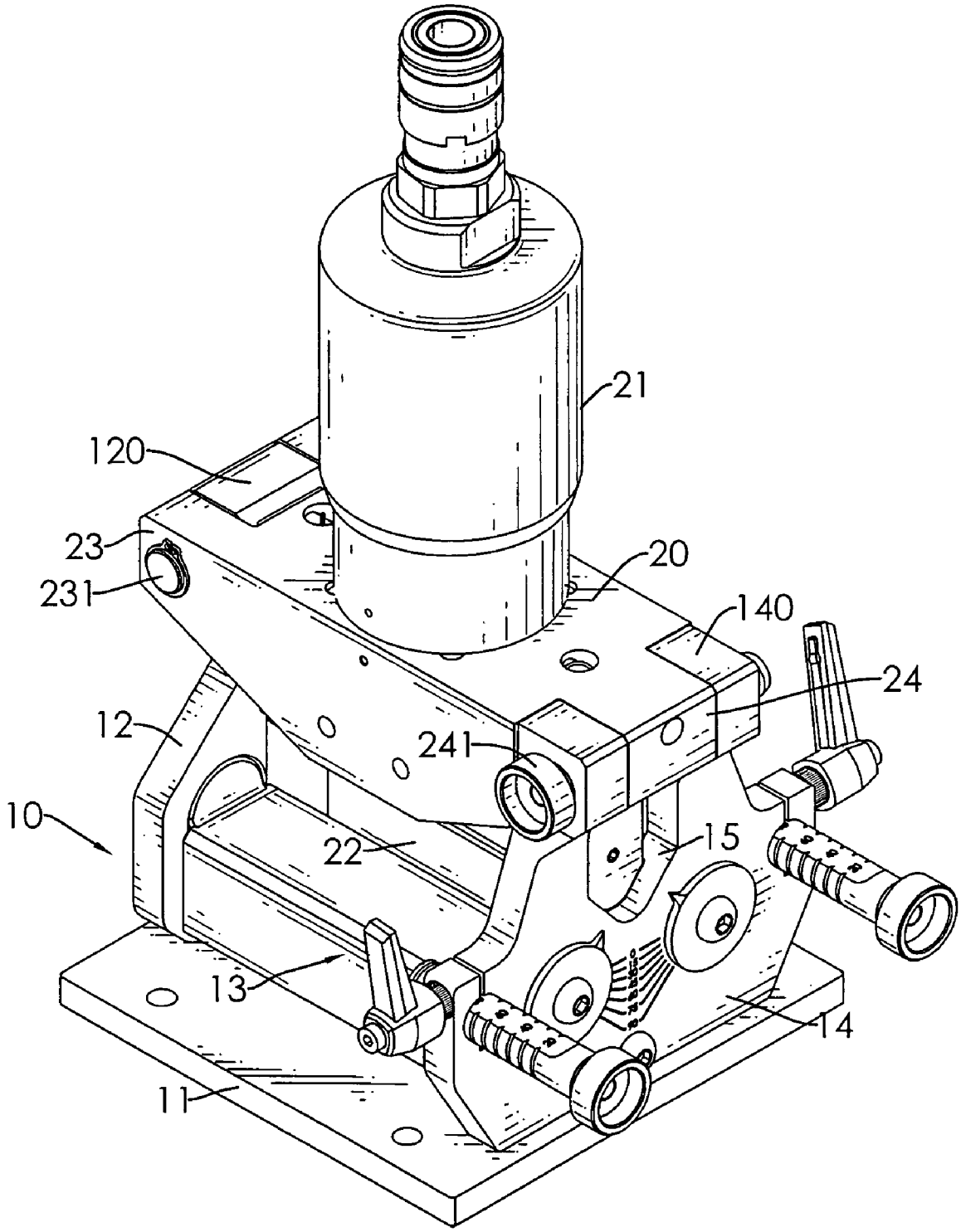
FIG. 1 is a perspective view of a bending machine in accordance with the present invention.
Figure 2:
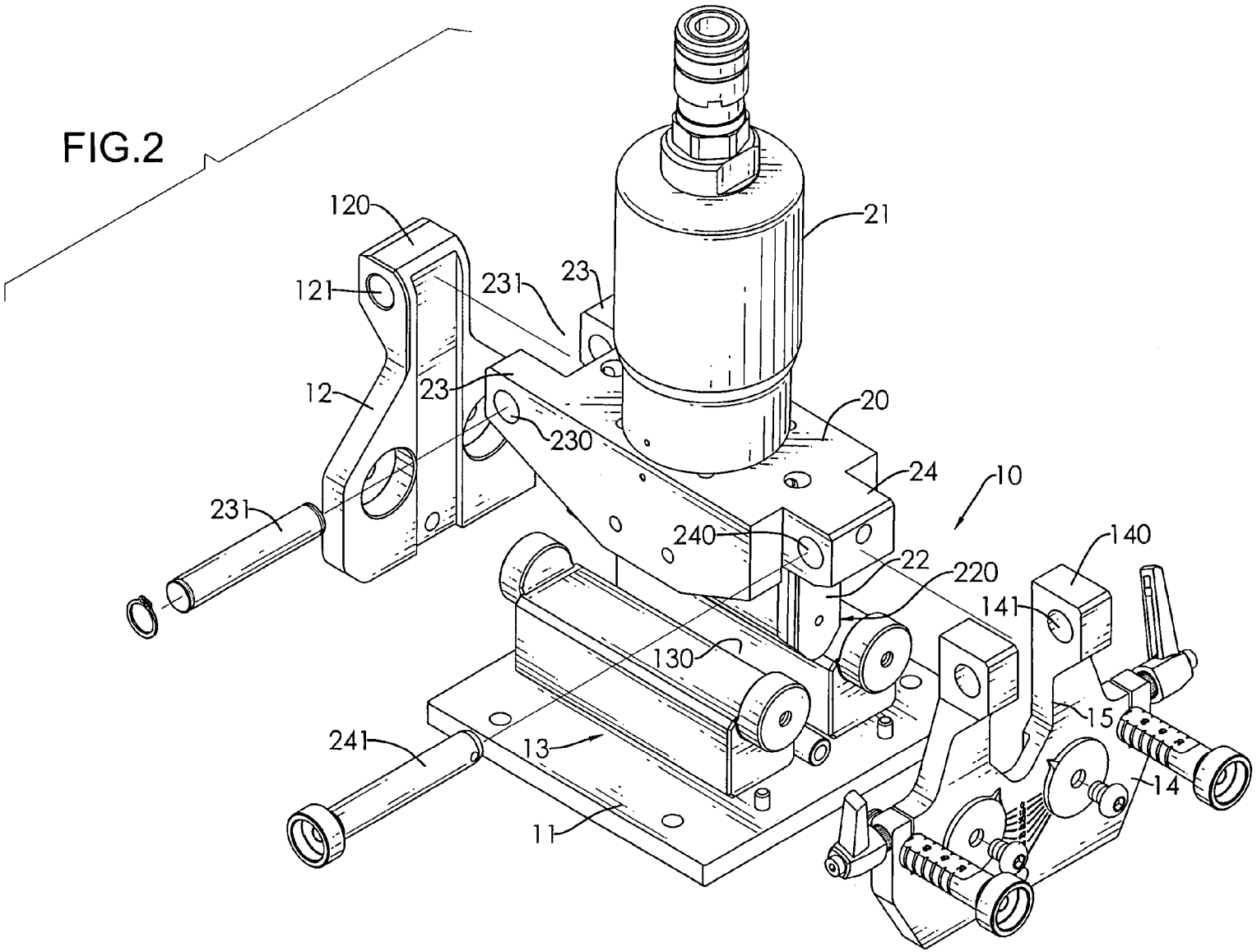
FIG. 2 is an exploded perspective view of the bending machine in FIG. 1.
Figure 3:
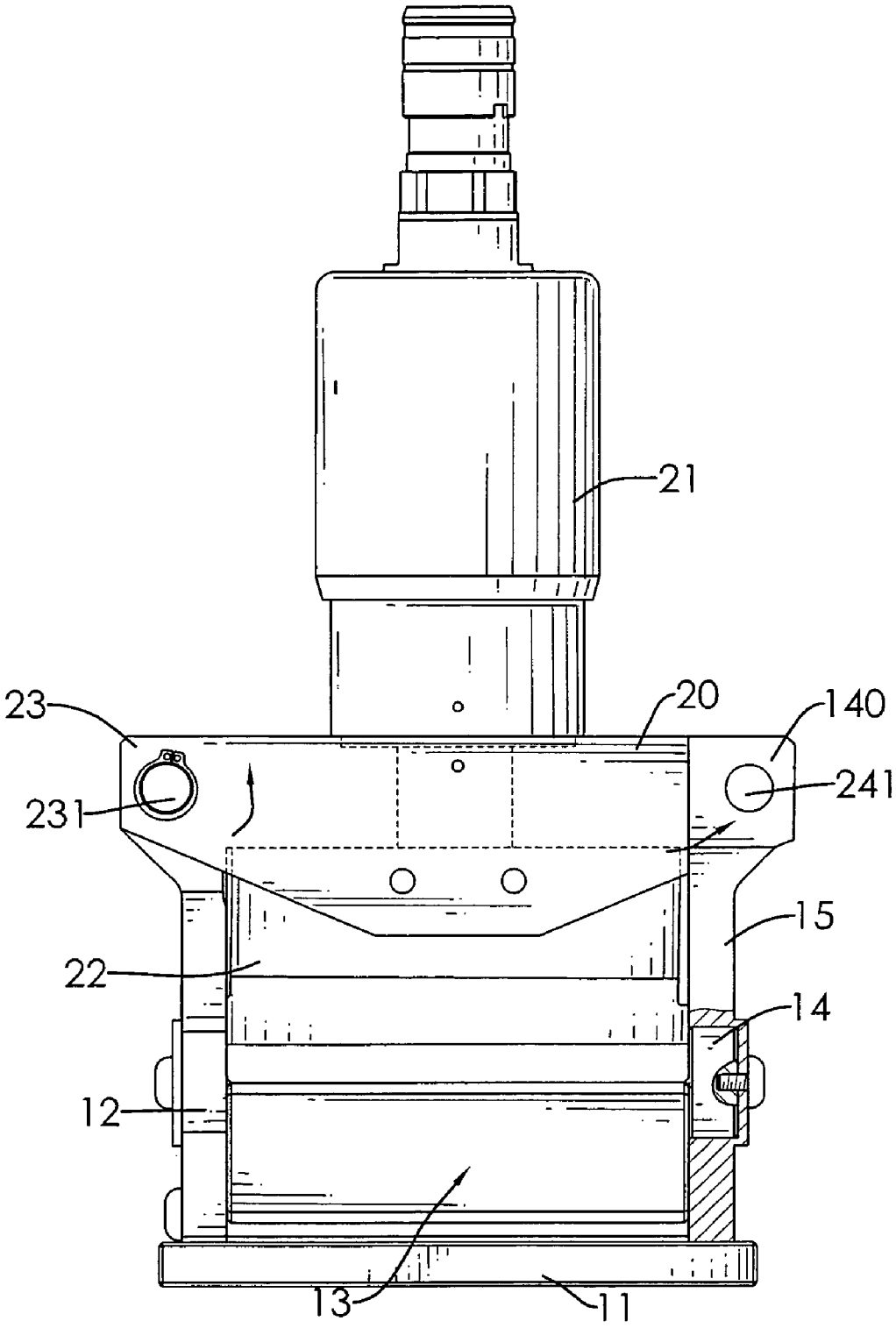
FIG. 3 is a side view in partial section of the bending machine in FIG. 1.

With reference to FIGS. 1, 2 and 3, the bending machine in accordance with present invention comprises a base (10), a stage (20), a pintle (231) and a pin (241).

The base (10) comprises a bottom board (11), a pivotal bracket (12), an opened bracket (14) and a mold die (13). The bottom board (11) has two sides, a top surface, may be squared and is implemented of placing on the ground or a plane surface. The pivotal bracket (12) and the opened bracket (14) are oppositely mounted securely on the top surface of the bottom board (11) near the two sides. The pivotal bracket (12) has a top and a pivotal portion (120) formed on the top. The pivotal portion (120) has a pivot hole (121) formed transversely therethrough. The opened bracket (14) is separated from and opposite to the pivotal bracket (12) and has a top, an opening (15) and two ears (140). The opening (15) is formed through the opened bracket (14) in the top. The ears (140) are formed oppositely on the top of the opened bracket (14) adjacent to the opening (15), and each ear (140) has a mounting hole (141) formed transversely through the ear (140) and aligns with the mounting hole (141) of the other ear (140). The mold die (13) is disposed on the top surface of the bottom board (11), is securely mounted between the pivotal bracket (12) and the opened bracket (14) and defines a flat surface for placing a metal plate and a longitudinal gap (130) formed in a middle of the flat surface between the pivotal bracket (12) and the opened bracket (14). The gap (130) may have two incline inner surfaces opposite to each other.

The stage (20) is connected with the base (10) and has a pivotal end (23), a detachable end, a driver (21) and a ram (22). The pivotal end (23) defines a notch (231) for receiving the pivotal portion (120) of the pivotal bracket (12) and has a through hole (230) formed transversely therethrough and coaxially aligning with the pivot hole (121) of the pivotal portion (120). The detachable end is adjacent to the opening (15) of the opened bracket (14) and has a protrusion (24) disposed between the ears (140) of the opened bracket (14). The protrusion (24) has a securing hole (240) formed transversely therethrough and coaxially aligning with the mounting holes (141) of the ears (140) of the opened bracket (14). The driver (21) may be a linear motor or a cylinder, is mounted securely on the stage (20) and has a shaft slidably mounted through the stage (20) and has a distal end corresponding to the gap (130) of the mold die (13). The ram (22) is mounted securely on the distal end of the shaft, with reference to FIG. 3, has an end corresponding to the opening (15) of the opened bracket (14) and a round bottom edge (220) facing to the gap (130) of the mold die (13) and is selectively driven by the driver (21) to press and bend the metal plate based on the shape of the gap (130).

The pintle (231) is mounted through the through hole (230) in the pivotal end (23) of the stage (20) and the pivot hole (121) in the pivotal portion (120) of the pivotal bracket (12) to pivotally attach the pivotal end (23) of the stage (20) to the pivotal bracket (12) of the base (10).

The pin (241) is mounted through the mounting holes (141) of the ears (140) of the opened bracket (14) and the securing hole (240) in the protrusion (24) of the stage (20) to detachably connect the detachable end of the stage (20) to the opened bracket (14) of the base (10).

Figure 4:
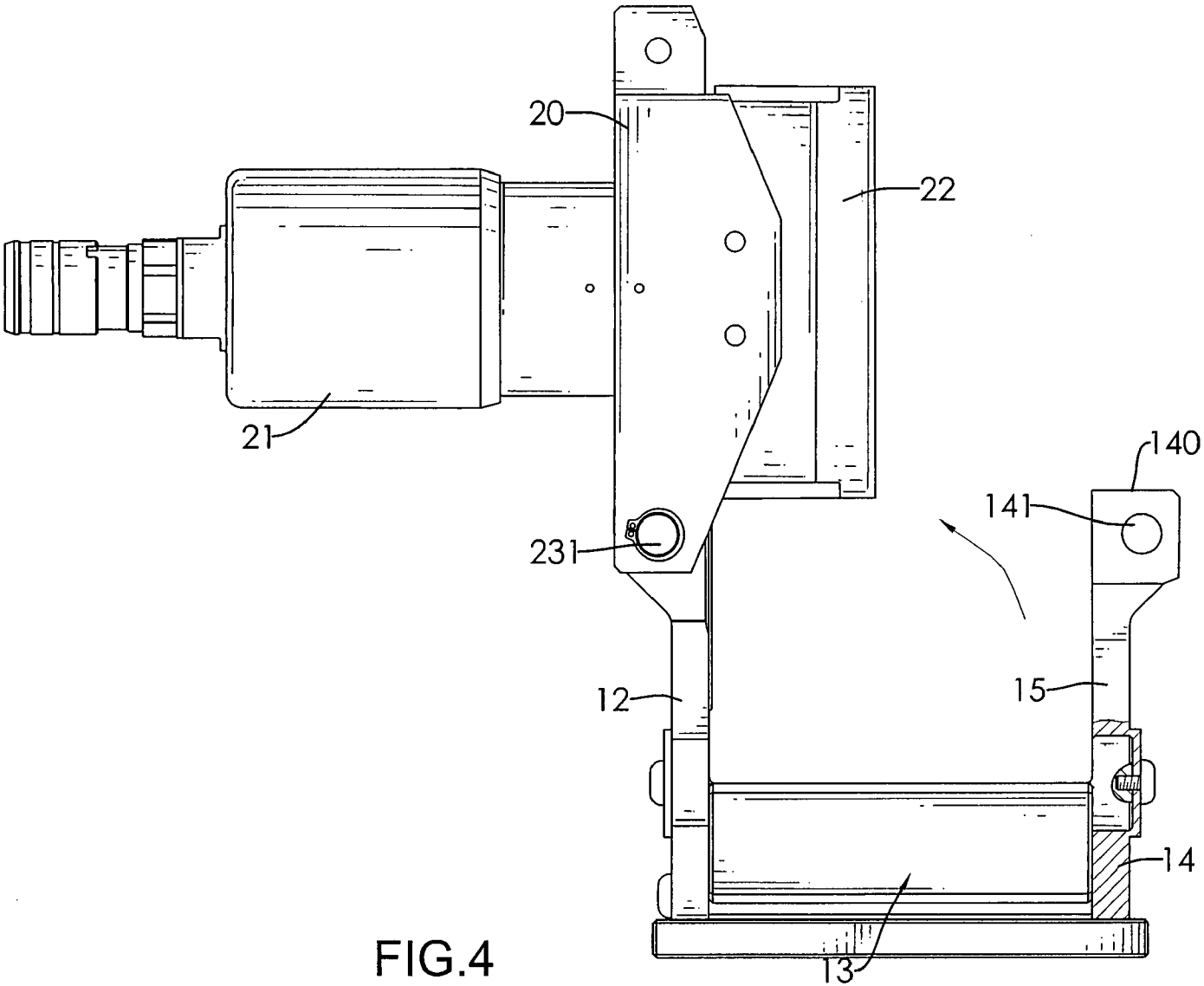
FIG. 4 is an operational side view in partial section of the bending machine in FIG. 1.
Figure 5:
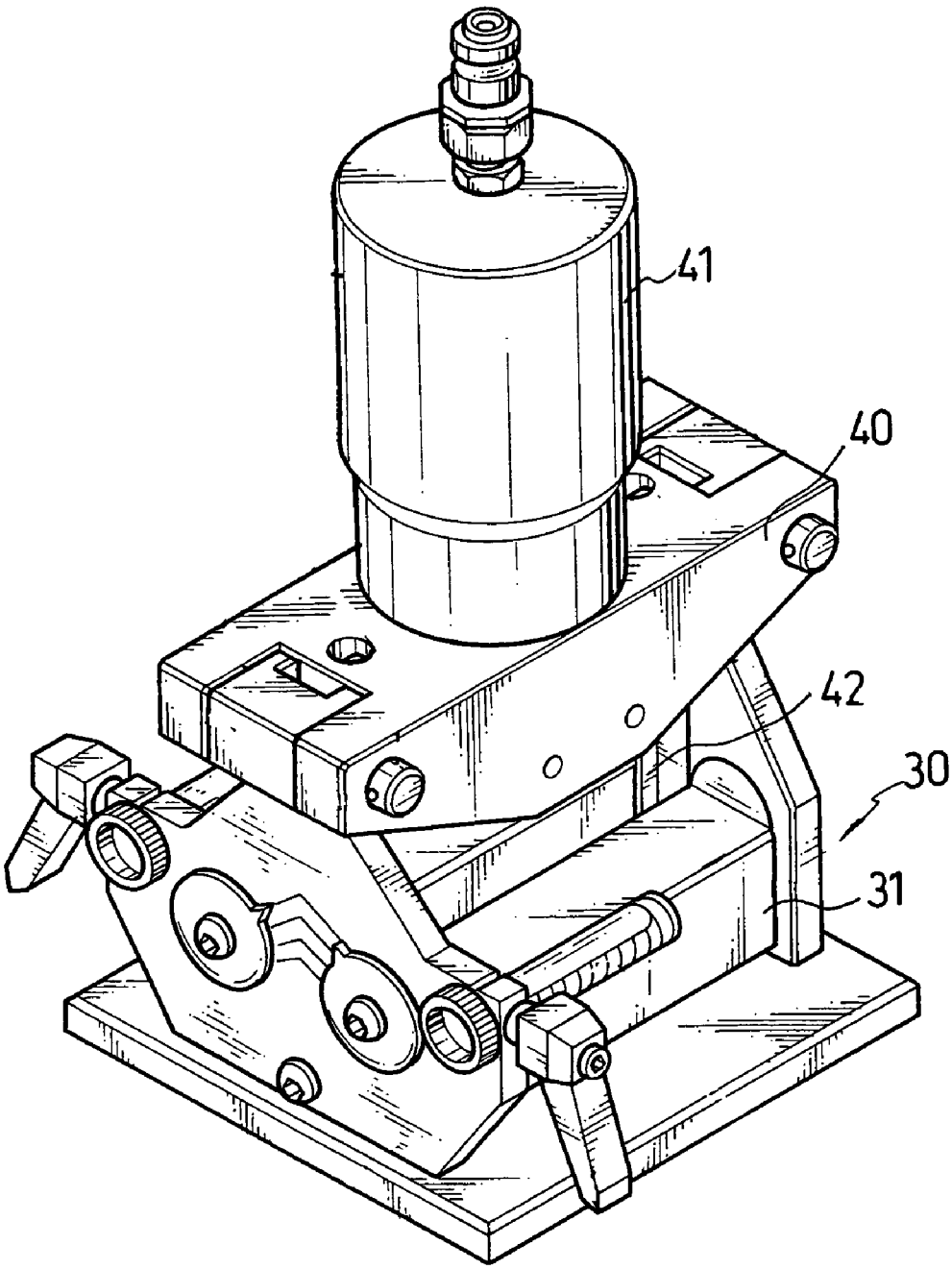
FIG. 5 PRIOR ART
FIG. 5 is a perspective view of a conventional bending machine in accordance with prior art.
Figure 6:
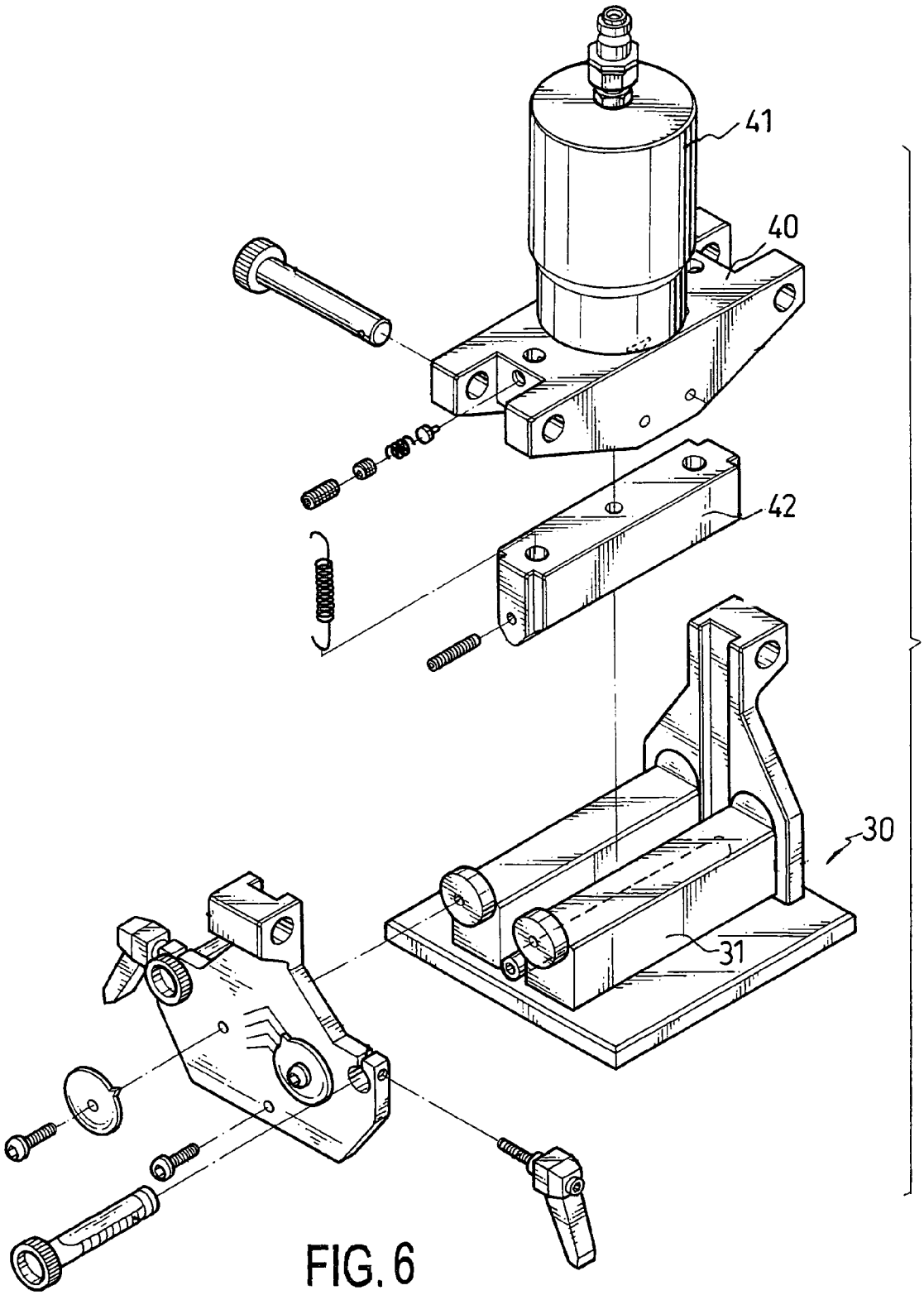
FIG. 6 PRIOR ART
FIG. 6 is an exploded perspective view of the conventional bending machine in FIG. 5.

With further reference to FIGS. 3 and 4, when a deformed metal plate tightly clamps the ram (22), the pin (241) is pulled out from the mounting holes (141) and the securing hole (240) to detach the detachable end of the stage (20) from the base (10). Then, the stage (20) is pivoted at the pintle (231). With the rotation of the stage (20), the ram (22) passes through the opening (15) and gradually departs from the metal plate. Thus, to disassemble the bending machine is unnecessary for releasing the ram (22). Therefore, the bending machine in accordance with present invention is convenient and rapid in use and operation and is simple in structure.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A bending machine comprising a base comprising a bottom board having two sides and a top surface;

a pivotal bracket being mounted securely on the top surface of the bottom board and having a top; and a pivotal portion formed on the top;

an opened bracket being mounted securely on the top surface of the bottom board, separated from and opposite to the pivotal bracket and having a top; and an opening being formed through the top of the opened bracket; and a mold die being disposed on the top surface of the bottom board and being securely mounted between the pivotal bracket and the opened bracket; and a stage having a pivotal end being pivotally connected with the pivotal portion of the pivotal bracket;

a detachable end being adjacent to the opening of the opened bracket and detachably connected with the opened bracket;

a driver being mounted securely on the stage and having a shaft slidably mounted through the stage; and a ram being mounted securely on the distal end of the shaft and having a side corresponding to the opening of the opened bracket, wherein the pivotal portion of the pivotal bracket has a pivot hole formed transversely through the pivotal portion;

the opened bracket has two ears being formed oppositely on the top of the opened bracket adjacent to the opening, and each ear has a mounting hole formed transversely through the ear and aligning with the mounting hole of the other ear;

the pivotal end of the stage has a through hole formed transversely through the pivotal end and coaxially aligning with the pivot hole of the pivotal portion;

the detachable end of the stage has a protrusion disposed between the ears of the opened bracket and having a securing hole formed transversely through the protrusion and coaxially aligning with the mounting holes of the ears of the opened bracket; and the bending machine further has a pintle being mounted through the through hole in the pivotal end of the stage and the pivot hole in the pivotal portion of the pivotal bracket to pivotally connect the pivotal end of the stage with the pivotal portion of the pivotal bracket of the base; and a pin being mounted through the mounting holes of the ears of the opened bracket and the securing hole in the protrusion of the stage to detachably connect the detachable end of the stage with the opened bracket of the base.

2. The bending machine as claimed in claim 1, wherein the mold die further defines a flat surface and a longitudinal gap formed in a middle of the flat surface between the pivotal bracket and the opened bracket;

the ram further has a round bottom edge facing to the gap of the mold die.

3. The bending machine as claimed in claim 1, wherein the pivotal end of the pivotal bracket further has a notch for receiving the pivotal portion of the stage.

* * * * *